US010414614B2

(12) United States Patent
Xu et al.

(10) Patent No.: US 10,414,614 B2
(45) Date of Patent: Sep. 17, 2019

(54) SHEET TRANSPORTING MECHANISM AND IMAGE FORMATION APPARATUS COMPRISING THE SAME

(71) Applicant: KONICA MINOLTA TECHNOLOGY DEVELOPMENT (WUXI) CO., LTD., Wuxi, Jiangsu (CN)

(72) Inventors: Jiangtao Xu, Jiangsu (CN); Jie Hu, Jiangsu (CN)

(73) Assignee: KONICA MINOLTA TECHNOLOGY DEVELOPMENT (WUXI) CO., LTD., Wuxi, Jiangsu (CN)

( * ) Notice: Subject to any disclaimer, the term of this patent is extended or adjusted under 35 U.S.C. 154(b) by 0 days.

(21) Appl. No.: 16/026,728

(22) Filed: Jul. 3, 2018

(65) Prior Publication Data

US 2019/0002228 A1 Jan. 3, 2019

(30) Foreign Application Priority Data

Jul. 3, 2017 (CN) ..... 2017 1 0532764

(51) Int. Cl.

| | |
|---|---|
| ***B65H 29/46*** | (2006.01) |
| ***B65H 29/00*** | (2006.01) |
| ***B65H 31/30*** | (2006.01) |

(52) U.S. Cl.

CPC ..... *B65H 29/46* (2013.01); *B65H 29/003* (2013.01); *B65H 31/3045* (2013.01);

(Continued)

(58) Field of Classification Search

CPC ..... B65H 29/46; B65H 2801/27; B65H 2301/4471; B65H 2405/52; B65H 31/3036; B65H 31/3045; B65H 31/3081

See application file for complete search history.

(56) References Cited

U.S. PATENT DOCUMENTS 7,832,718 B2 * 11/2010 Fukasawa ..... B42C 1/125 270/58.07

7,992,856 B2 * 8/2011 Saito ..... B65H 31/3027 270/58.08

(Continued)

FOREIGN PATENT DOCUMENTS

JP 2015-20822 A 2/2015

*Primary Examiner* — Patrick Cicchino

(74) *Attorney, Agent, or Firm* — Osha Liang LLP

(57) ABSTRACT

A sheet transporting mechanism transports a sheet from a storage tray to a stacking tray, and includes: a first transporter that moves between initial and first positions to transport the sheet from the initial position toward the stacking tray; a second transporter that transports the transported sheet by the first transporter to the stacking tray; a single motor that drives the first and second transporters; a guide rail that guides movement of the second transporter; a first transmission gear that transmits a driving force of the single motor to move the first transporter between the initial and first positions; a second transmission gear that transmits the driving force of the single motor to move the guide rail in an upward and downward direction; and a third transmission gear that transmits the driving force of the single motor to allow the second transporter to be guided by the guide rail.

10 Claims, 21 Drawing Sheets

(52) U.S. Cl.
CPC . *B65H 31/3081* (2013.01); *B65H 2301/4471* (2013.01); *B65H 2403/51* (2013.01)

(56) References Cited

U.S. PATENT DOCUMENTS

| | | | | |
|---|---|---|---|---|
| 8,109,497 | B2 * | 2/2012 | Okamoto | B65H 37/04 270/20.1 |
| 8,523,166 | B2 * | 9/2013 | Jung | B65H 31/34 270/58.08 |
| 9,919,892 | B1 * | 3/2018 | Kamata | B65H 31/34 |
| 2012/0032388 | A1 | 2/2012 | Jung | |
| 2018/0022561 | A1 * | 1/2018 | Hama | G03G 15/6552 271/128 |

* cited by examiner

PERFORMANCE CHART FOR CONVENTIONAL ART

PERFORMANCE CHART FOR 1ST EMBODIMENT

SHEET TRANSPORTING MECHANISM AND IMAGE FORMATION APPARATUS COMPRISING THE SAME

CROSS-REFERENCE TO RELATED APPLICATIONS

Chinese Patent Application No. 201710532764.9 filed on Jul. 3, 2017, including description, claims, drawings, and abstract the entire disclosure is incorporated herein by reference in its entirety.

BACKGROUND

Technical Field

The present invention relates to a sheet transporting mechanism and an image formation apparatus comprising the same.

Description of the Related Art

For example, U.S. Patent Publication No. 2012/0032388 and Japanese Laid-Open Patent Publication No. 2015-020822 disclose an image formation apparatus having a sheet transporting mechanism in which it is necessary that sheets having images formed thereon are fed out by a sheet feeding system and accumulated in a storage tray and the accumulated sheets are bound by a sheet binding means and then transported in a transporting direction and thus discharged to a stack tray located downstream of the transporting direction, as conventional.

U.S. Patent Publication No. 2012/0032388 discloses an image formation apparatus comprising a body provided with a console panel. The console panel includes a first panel separated from the apparatus's body and a second panel adjacent to the first panel and associated with the apparatus's body, and the first panel and the second panel are coupled positionally changeably between a first position allowing the first and second panels to have their respective panel surfaces generally flush with each other and a second position allowing the first and second panels to be bent upward.

Achieving such an operation as above requires using two driving sources or two one-way clutches. For example, U.S. Patent Publication No. 2012/0032388 discloses adopting two one-way clutches.

Furthermore, Japanese Laid-Open Patent Publication No. 2015-020822 discloses adopting two motors.

SUMMARY

The configuration disclosed in U.S. Patent Publication No. 2012/0032388 requires driving by a double pulse signal, resulting in relatively low productivity. Moreover, because of a characteristic of the one-way clutch, precision also deteriorates. Furthermore, separately installing the one-way clutches invites increased cost.

The configuration of Japanese Laid-Open Patent Publication No. 2015-020822 requires precisely controlling the operation of each mechanism, and accordingly, it must select an expensive stepping motor, which results in significantly increased cost. Furthermore, a gripper reciprocates over a sheet passage plane, and accordingly, productivity is decreased.

SUMMARY

One or more embodiments of the present invention provide a sheet transporting mechanism capable of reducing cost while also increasing productivity and an image formation apparatus comprising the same.

A sheet transporting mechanism according to one or more embodiments of the present invention is a sheet transporting mechanism that transports a sheet from a storage tray to a stacking tray, comprising: a first transporting member configured to move between an initial position and a first position to transport the sheet from the initial position toward the stacking tray; a second transporting member configured to take over transporting to the stacking tray the sheet transported by the first transporting member; a single motor solely provided in the sheet transporting mechanism and configured to drive the first transporting member and the second transporting member; a guide unit configured to guide movement of the second transporting member; a first transmission unit configured to transmit a driving force of the motor to the first transporting member to move the first transporting member between the initial position and the first position; a second transmission unit configured to transmit the driving force of the motor to the guide unit to move the guide unit in an upward and downward direction; and a third transmission unit configured to transmit the driving force of the motor to the second transporting member to allow the second transporting member to be guided by the guide unit and thus moved, the first transmission unit having a driving force interruption unit configured to temporarily interrupt the driving force to be transmitted to the first transporting member.

An image formation apparatus according to one or more embodiments of the present invention comprises the sheet transporting mechanism described above.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
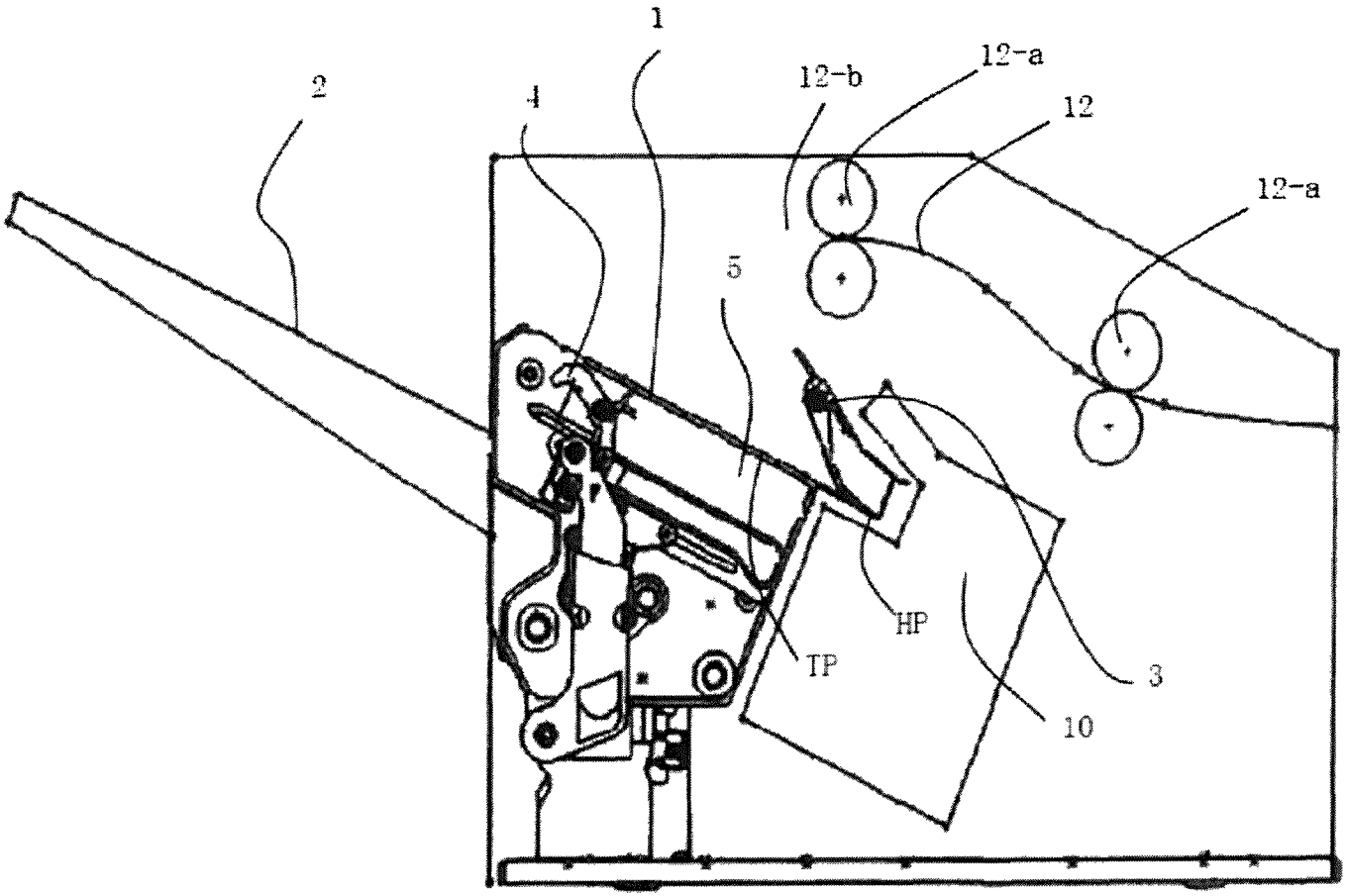
FIG. 1 is a schematic diagram showing a local part of an image formation apparatus having a sheet transporting mechanism according to one or more embodiments of the present invention.

Hereinafter, embodiments of the present invention will be described with reference to the drawings. However, the scope of the invention is not limited to the disclosed embodiments.

Hereinafter, with reference to the drawings, embodiments of the present invention will now be described in detail. Those skilled in the art can implement various alternative embodiments based on suggestions from these embodiments, and the present invention is not limited to the embodiments described herein. For convenience for understanding the present invention, some figures do not indicate reference characters indicated in other figures.

A sheet transporting mechanism according to one or more embodiments of the present invention is applied to an image formation system or the like, and specifically, it is applied to a sheet binding mechanism that binds sheets which have images formed thereon and are subsequently accumulated.

FIG. 1 is a schematic diagram showing a local part of an image formation apparatus having a sheet transporting mechanism according to one or more embodiments of the present invention. As shown in FIG. 1, a sheet on which an image is formed by an image forming section (not shown) is fed out by a sheet transporting system 12 provided upstream of a transporting direction and is accumulated in a storage tray 1 of the sheet transporting mechanism, and such accumulated sheets are bound by a sheet binding device 10, and thereafter transported in the transporting direction and discharged to a stacking tray 2 provided downstream of the transporting direction.

As shown in FIG. 1, sheet transporting system 12 is coupled to the image forming means (not shown), includes a plurality of transporting roller pairs 12-*a* and a sheet discharging port 12-*b*, and transports a sheet having an image formed thereon by the image forming means (not shown) in the transporting direction by the plurality of transporting roller pairs 12-*a* and discharges the sheet to storage tray 1 of the sheet transporting mechanism via sheet discharging port 12-*b*. Of course, in addition to the plurality of transporting roller pairs 12-*a* and sheet discharging port 12-*b*, sheet transporting system 12 further includes sheet feeding, other relevant mechanisms, although not described herein.

The sheet transporting mechanism is disposed downstream of the transporting direction of sheet discharging port 12-*b* of sheet transporting system 12, and in order to accumulate sheets from sheet discharging port 12-*b*, includes storage tray 1 for supporting the sheets. In the vicinity of storage tray 1, for example under sheet transporting system 12, sheet binding device 10 is disposed for binding the sheets accumulated on storage tray 1. Stacking tray 2 is provided on a side opposite to sheet transporting system 12 with storage tray 1 interposed, that is, downstream of the transporting direction, and sheets processed on storage tray 1 are transported to stacking tray 2 by the sheet transporting mechanism. Hereinafter, the sheet transporting mechanism according to one or more embodiments of the present invention will be described with reference to FIGS. 2 to 16.

Figure 2:
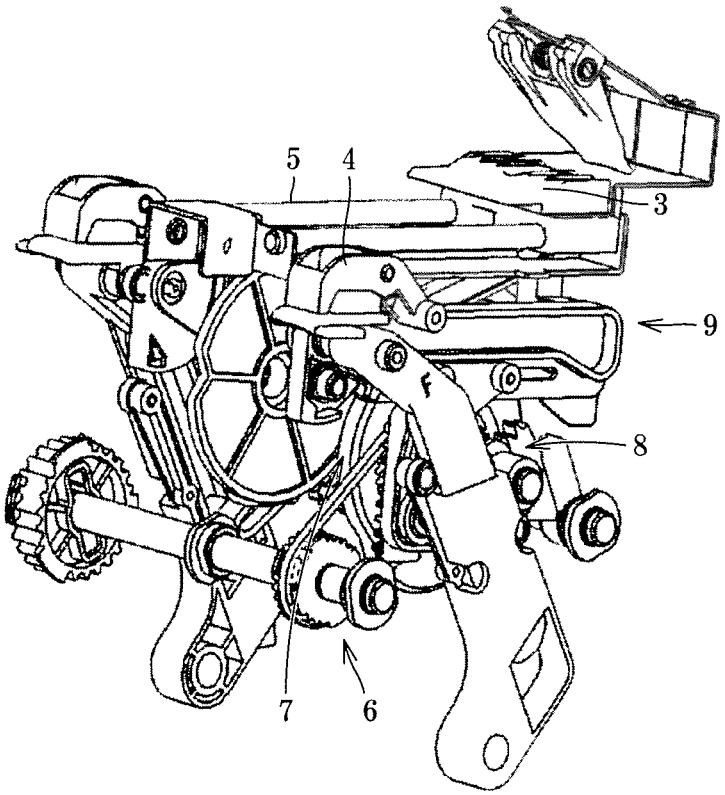
FIG. 2 is a schematic diagram showing the sheet transporting mechanism according to one or more embodiments of the present invention.

FIG. 2 is a schematic diagram showing the sheet transporting mechanism according to one or more embodiments of the present invention. As shown in FIG. 2, the sheet transporting mechanism according to one or more embodiments of the present invention has a first transporting member (first transporter) 3 and a second transporting member (second transporter) 4. First transporting member 3 (hereinafter referred to for example as a "thrusting unit" for the sake of convenience) is a member to temporarily thrust sheets processed on storage tray 1, and when it does not operate it is located upstream of storage tray 1 in the transporting direction, that is, at an initial position HP, and when it operates it moves from initial position HP to the vicinity of the center of storage tray 1, that is, a first position TP, and transports processed sheets from storage tray 1 toward stacking tray 2. Second transporting member 4 (hereinafter referred to for example as a "gripper" for the sake of convenience) takes over transporting the sheets transported by thrusting unit 3 and continues doing so until the sheets are transported to stacking tray 2.

Further, the sheet transporting mechanism according to one or more embodiments of the present invention further includes constituent members such as a sole motor M, a first transmission unit (first transmission gear) 6, a second transmission unit (second transmission gear) 7, and a third transmission unit (third transmission gear) 8. These members will be described in detail below. For convenience of illustration, a direction opposite to a direction in which motor M outputs a driving force, that is, a direction toward motor M, is defined as a positive direction along the X axis, a direction orthogonal to the X axis and actually directed toward initial position HP is defined as a positive direction along the Y axis, and a direction orthogonal to the X axis and the Y axis and actually directed upward is defined as a positive direction along the Z axis.

The sheet transporting mechanism according to one or more embodiments of the present invention has only one motor M for thrusting unit 3 and gripper 4, that is, there is only one motor M in the sheet transporting mechanism to drive thrusting unit 3 and gripper 4. That is, motor M drives first transmission unit 6, second transmission unit 7, and third transmission unit 8. First transmission unit 6 transmits the driving force of motor M to thrusting unit 3 to move thrusting unit 3 between initial position HP and first position TP. Second transmission unit 7 transmits the driving force of motor M to a guide unit 9 to move guide unit 9 in an upward and downward direction. Third transmission unit 8 transmits the driving force of motor M to gripper 4 to allow gripper 4 to be guided by guide unit 9 and thus moved.

Figure 3:
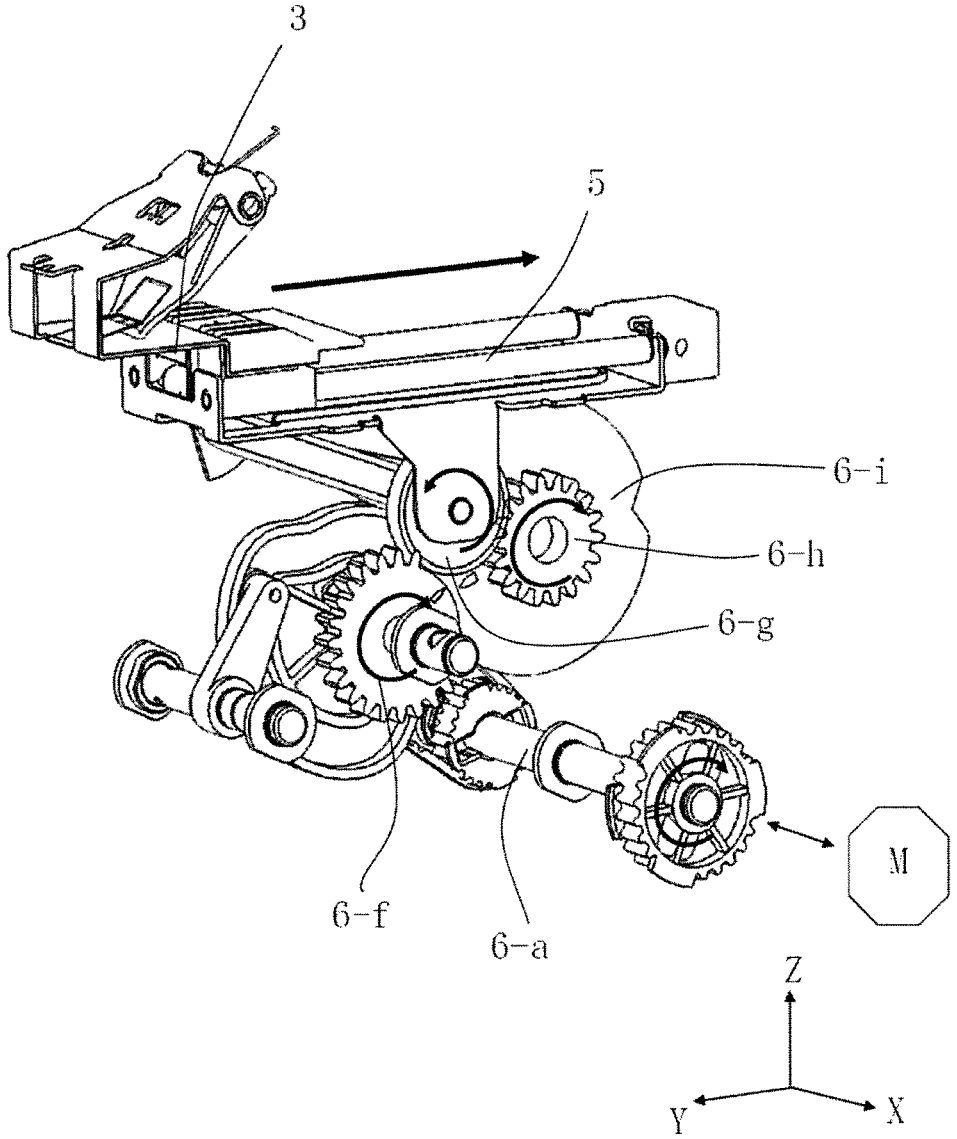
FIG. 3 is a schematic diagram showing a thrusting operation of a first transmission unit of the sheet transporting mechanism according to one or more embodiments of the present invention.
Figure 4:
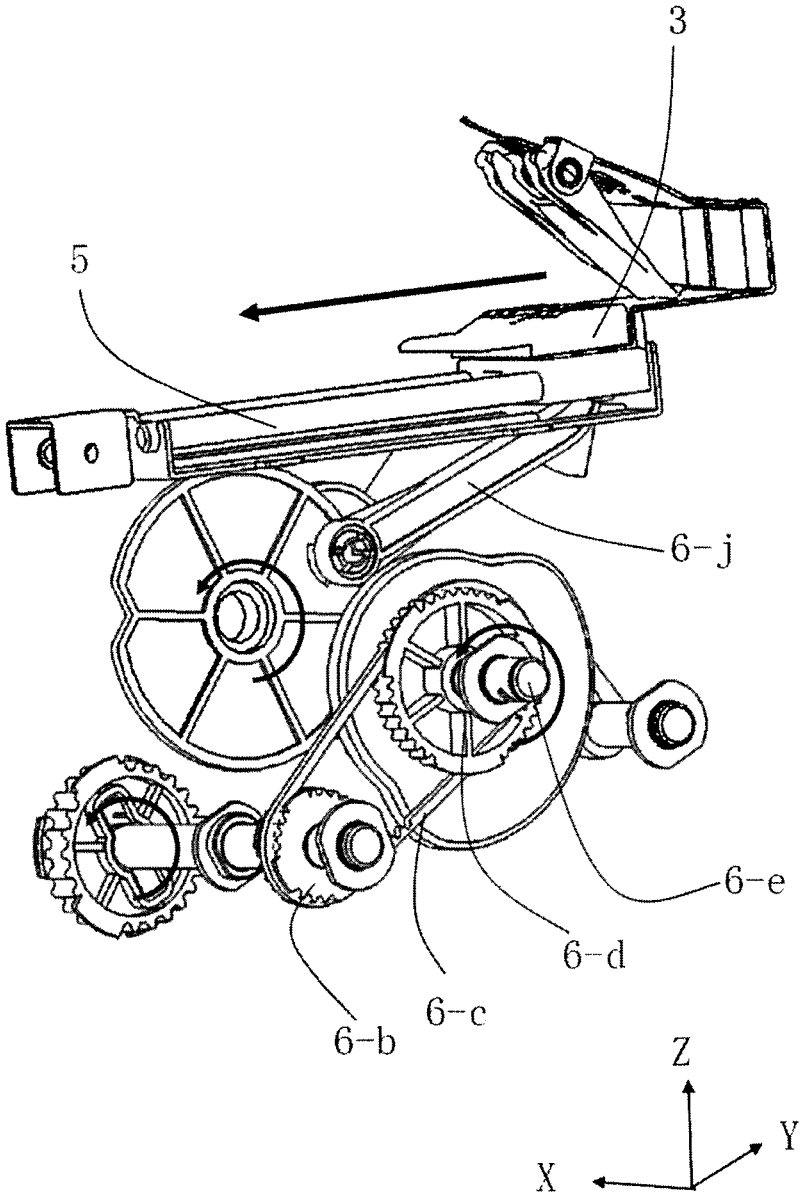
FIG. 4 is a schematic diagram showing the first transmission unit of the sheet transporting mechanism according to one or more embodiments of the present invention.

First transmission unit 6 is structured specifically as follows: FIG. 3 is a schematic diagram showing a thrusting operation of the first transmission unit of the sheet transporting mechanism according to one or more embodiments of the present invention. FIG. 4 is a schematic diagram showing the first transmission unit of the sheet transporting mechanism according to one or more embodiments of the present invention.

As shown in FIGS. 3 and 4, first transmission unit 6 is a mechanism connected to motor M and driven by motor M. First transmission unit 6 has a rotation shaft 6-*a* coupled to the output shaft of motor M, and rotation shaft 6-*a* is disposed along the X axis and rotated by the driving force received from motor M. A pulley 6-*b* is meshed with one end of rotation shaft 6-*a* facing away from motor M, that is, in a negative direction along the X axis, and thus rotates together with rotation shaft 6-*a*.

A pulley 6-*d* is provided, spaced, as predetermined, from pulley 6-*b*. Pulley 6-*d* is provided obliquely above pulley 6-*b*, that is, at a position more positive along the Z axis than pulley 6-*b*, and is also provided on a rotation shaft 6-*e* which is a shaft different from rotation shaft 6-*a* to mesh with rotation shaft 6-*e* and is also ganged or interlocked with pulley 6-*b* via a belt 6-*c* to rotate as pulley 6-*b* rotates.

A partial gear 6-*f* is provided at one end of rotation shaft 6-*e* opposite to pulley 6-*d*, that is, in the positive direction along the X axis. Partial gear 6-*f* has a circumferential portion partially toothed continuously, and meshes with rotation shaft 6-*e* or is secured to pulley 6-*d* via a member such as a pin (not shown). On one side of partial gear 6-*f* in the positive direction along the Z axis, a gear 6-*g* is provided to intermittently mesh with partial gear 6-*f*, that is, while partial gear 6-*f* is rotating, when partial gear 6-*f* has the toothed portion facing gear 6-*g*, partial gear 6-*f* meshes with gear 6-*g*, whereas when partial gear 6-*f* has an untoothed portion facing gear 6-*g*, partial gear 6-*f* idles and does not transmit power.

On a side of rotation gear 6-*g* facing away from partial gear 6-*f*, there is provided a gear 6-*h* meshing with gear 6-*g* and rotating as gear 6-*g* rotates. A cam 6-*i* is provided so as to rotate together with gear 6-*h* coaxially, and on a surface of cam 6-*i* facing away from gear 6-*h*, i.e., on a negative side thereof along the X axis, a link 6-*j* is connected which has one end coupled to cam 6-*i* and the other end coupled to thrusting unit 3 provided above first transmission unit 6.

First transmission unit 6 operates in a manner to cause thrusting unit 3 to perform a thrusting operation (an operation to previously discharge a sheet), specifically as follows:

As motor M outputs rotation (that is, rotates clockwise in FIG. 3), rotation shaft 6-*a* coupled to the output shaft of motor M starts to rotate (clockwise in FIG. 3), and partial gear 6-*f* is also rotated via pulley 6-*b*, belt 6-*c*, pulley 6-*d* and rotation shaft 6-*e* (clockwise in FIG. 3).

During the rotation of partial gear 6-*f*, when partial gear 6-*f* has the toothed portion facing gear 6-*g*, partial gear 6-*f* meshes with gear 6-*g* and the rotation is transmitted via gear 6-*g* and gear 6-*h* to cam 6-*i*. Since cam 6-*i* and link 6-*j* constitute a cam-link mechanism (a clamp link mechanism), a curved movement can be converted into a linear movement along a slide rail 5, that is, along the Y axis, that is, thrusting unit 3 is linearly moved between initial position HP and first position TP. In contrast, when partial gear 6-*f* has the untoothed portion facing gear 6-*g*, partial gear 6-*f* idles and does not transmit power, and at that time, the movement of thrusting unit 3 temporarily stops.

Thus, causing first transmission unit 6 to operate to cause thrusting unit 3 to reciprocate along slide rail 5 within a predetermined range, that is, between initial position HP and first position TP, transports a sheet from initial position HP toward the stacking tray.

Figure 5:
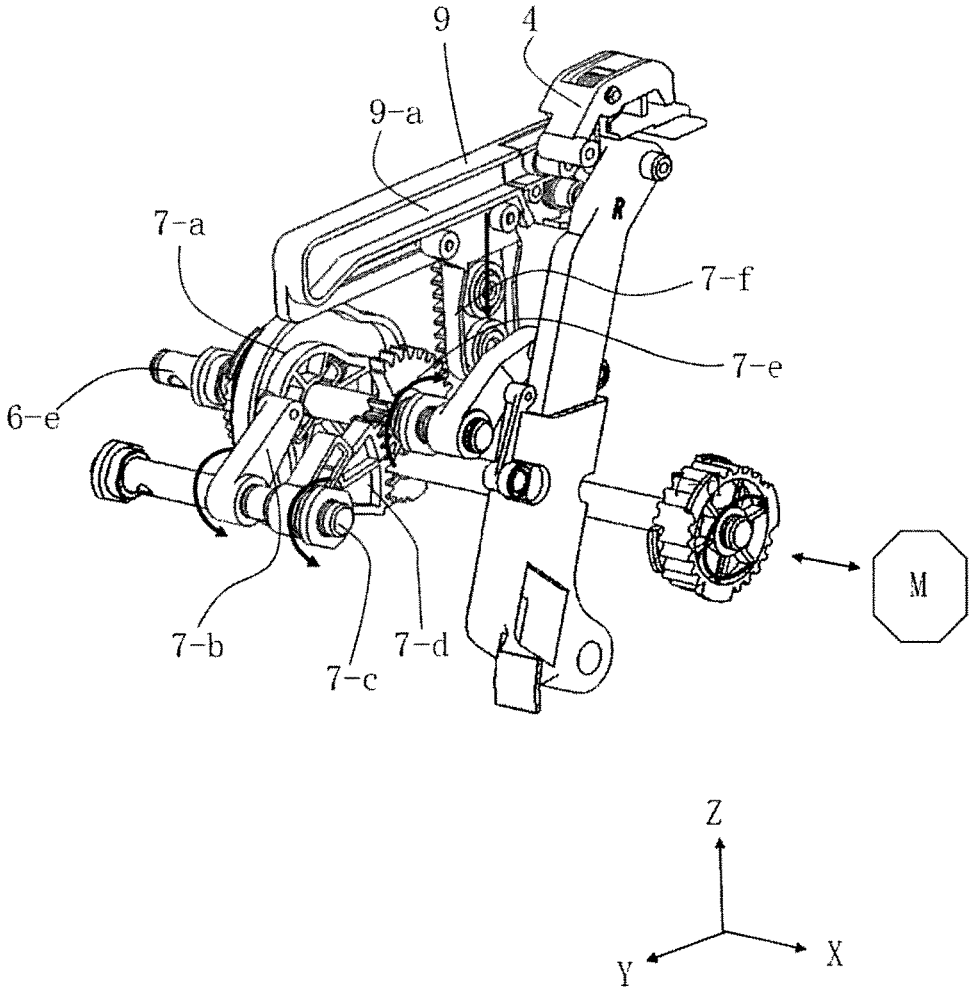
FIGS. 5 to 8 are schematic diagrams showing a second transmission unit of the sheet transporting mechanism according to one or more embodiments of the present invention.
Figure 6:
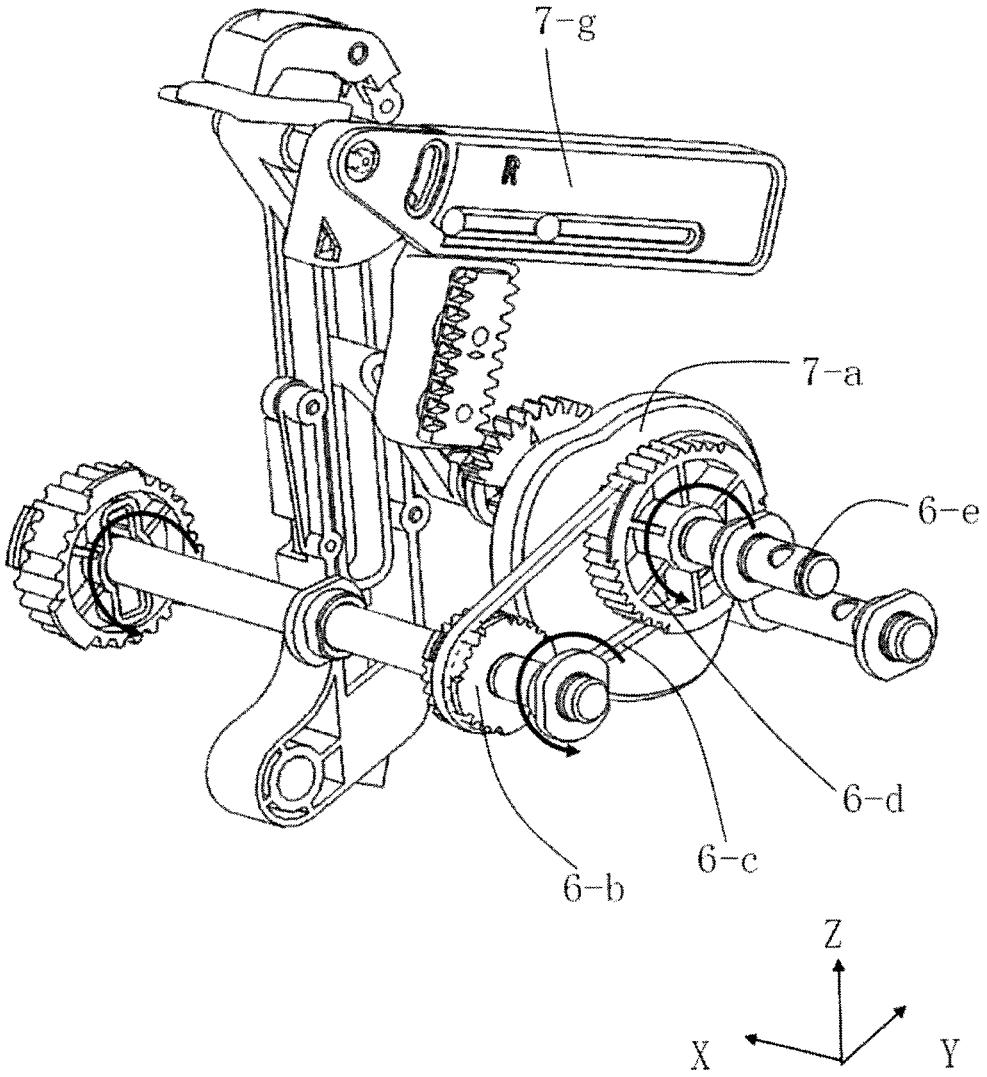

Second transmission unit 7 is structured as follows: FIG. 5 is a schematic diagram showing the second transmission unit of the sheet transporting mechanism according to one or more embodiments of the present invention. FIG. 6 is a schematic diagram showing the second transmission unit of the sheet transporting mechanism according to one or more embodiments of the present invention.

As shown in FIGS. 5 and 6, second transmission unit 7 is partially composed of components of first transmission unit 6. Accordingly, any component that is the same as first transmission unit 6 will simply be described or not be described.

In the transmission system of first transmission unit 6 on rotation shaft 6-*e* at a position more positive along the X axis than pulley 6-*d*, a cam 7-*a* is provided which is adjacent to pulley 6-*d* and meshes with rotation shaft 6-*e* or is secured to pulley 6-*d* via a pin or the like (not shown). That is, cam 7-*a*, pulley 6-*d*, and rotation shaft 6-*e* rotate synchronously about the axis of rotation shaft 6-*e*. On a surface of cam 7-*a* facing away from pulley 6-*d*, i.e., on a positive side along the X axis, a cam-shaped groove is formed along the cam's circumference, and a link 7-*b* is coupled in the cam-shaped groove, and link 7-*b* has one end coupled in the cam-shaped groove of cam 7-*a* and has the other end coupled to a pivot shaft 7-*c* provided on a side more positive along the Y axis than cam 7-*a*. Link 7-*b* can thus rotate back and forth along the cam-shaped groove.

A partial gear 7-*d* is provided on pivot shaft 7-*c* at a position more positive along the X axis than link 7-*b*, and partial gear 7-*d* is, for example, a sectorial gear, that is, only toothed at a surface of an end portion of the sector, and meshes with rotation shaft 7-*c* and thus rotates together therewith. That is, link 7-*b*, rotation shaft 7-*c*, and partial gear 7-*d* rotate synchronously about the axis of rotation shaft 7-*c*. A partial gear 7-*e* is provided on a side more negative along the Y axis than partial gear 7-*d*, and to be able to rotate relatively with respect to rotation shaft 6-*e*, partial gear 7-*e* is provided on rotation shaft 6-*e* at a position more positive along the X axis than cam 7-*a*, and meshes with partial gear 7-*d* and rotates as partial gear 7-*d* rotates. Note that, of partial gear 7-*e*, one side meshing with partial gear 7-*d* has a smaller radius and the other side has a larger radius.

A rack 7-*f* is meshed with a side of partial gear 7-*e* facing away from partial gear 7-*d*, i.e., a side thereof negative along the Y axis. Rack 7-*f* meshes with the larger-diameter side of partial gear 7-*e* and also reciprocates in an upward and downward direction, that is, along the Z axis, as partial gear 7-*e* rotates. Guide unit 9 is connected to an upper side of rack 7-*f*, and guide unit 9 is a member for guiding gripper 4, and internally provided with a guide rail 9-*a* for guiding gripper 4. Guide unit 9 is secured to an upper side of rack 7-*f*, and interlocked with rack 7-*f* to reciprocate in an upward and downward direction to allow gripper 4 to reciprocate in an upward and downward direction.

Second transmission unit 7 operates in a manner to cause the gripper to operate in the upward and downward direction (i.e., perform an upward and downward reciprocating operation during a discharging cycle operation done by the gripper), specifically as follows:

As motor M outputs rotation (that is, rotates clockwise in FIG. 5), rotation shaft 6-*a* coupled to the output shaft of motor M starts to rotate, and cam 7-*a* is also rotated via pulley 6-*b*, belt 6-*c*, pulley 6-*d* and rotation shaft 6-*e* (clockwise in FIG. 5).

During the rotation of cam 7-*a*, link 7-*b* rotates back and forth (or rocks) on cam 7-*a* along the cam-shaped groove, and accordingly, partial gear 7-*d* starts to reciprocate (or rock) in synchronization with link 7-*b* via pivot shaft 7-*c*, and transmits the rotation to rack 7-*f* via partial gear 7-*e* to cause rack 7-*f* to reciprocate in the upward and downward direction so that via guide 9 gripper 4 can be caused to reciprocate in the upward and downward direction.

Specifically, for example, as shown in FIG. 5, when cam 7-*a* pivots and accordingly, link 7-*b* is guided by the cam-shaped groove and thus rotated counterclockwise, partial gear 7-*d* starts to rotate in synchronization with link 7-*b* counterclockwise, and at that time, partial gear 7-*e* meshed with partial gear 7-*d* rotates clockwise and rack 7-*f* meshed with partial gear 7-*e* moves downward and guide unit 9 coupled to rack 7-*f* moves downward, whereby gripper 4 provided on guide unit 9 moves downward. In contrast, when cam 7-*a* pivots and accordingly, link 7-*b* is guided by the cam-shaped groove and thus rotated clockwise, partial gear 7-*d* starts to rotate in synchronization with link 7-*b* clockwise, and at that time, partial gear 7-*e* meshed with partial gear 7-*d* rotates counterclockwise and rack 7-*f* meshed with partial gear 7-*e* moves upward and guide unit 9 coupled to rack 7-*f* moves upward, whereby gripper 4 provided on guide unit 9 moves upward.

Figure 7:
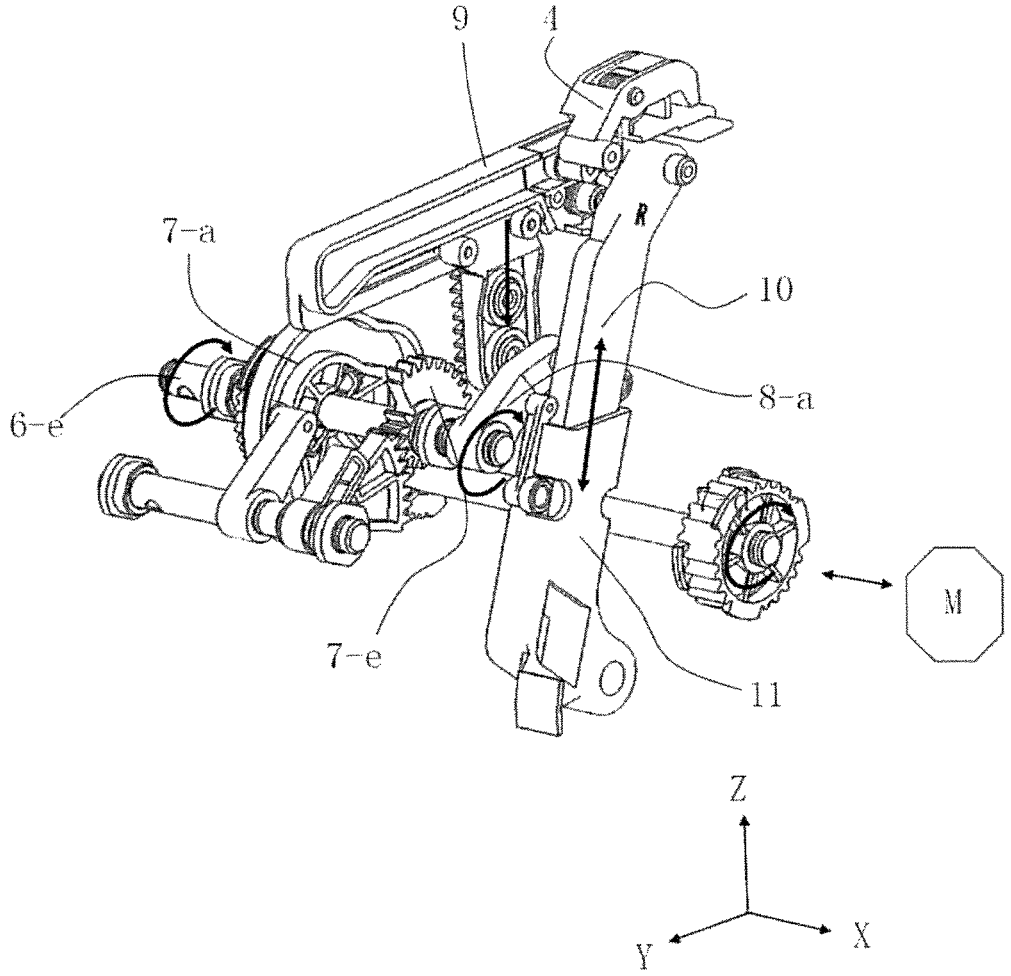
Figure 8:
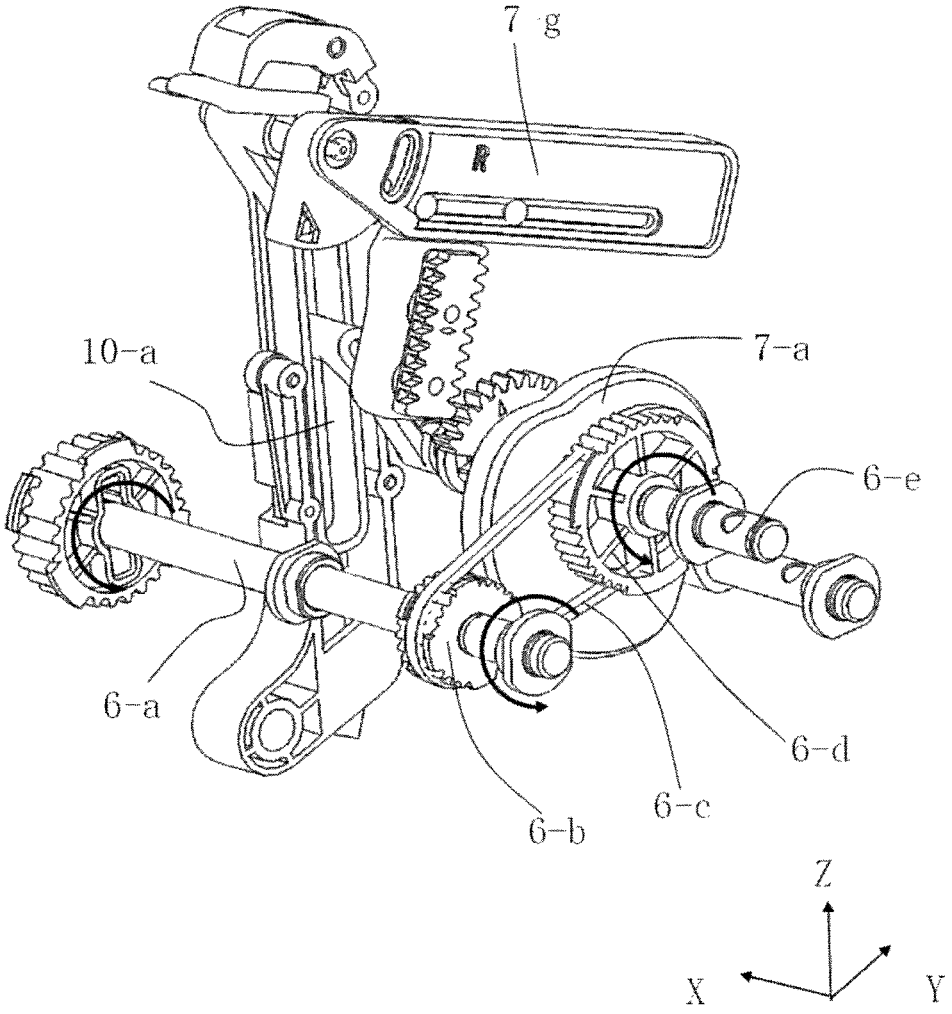

Third transmission unit 8 is structured specifically as follows: FIG. 7 is a schematic diagram showing the second transmission unit of the sheet transporting mechanism according to one or more embodiments of the present invention. FIG. 8 is a schematic diagram showing the second transmission unit of the sheet transporting mechanism according to one or more embodiments of the present invention.

As shown in FIGS. 7 and 8, third transmission unit 8 is partially composed of components of first and second transmission units 6 and 7. Accordingly, any component that is the same as first and second transmission units 6 and 7 will simply be described or not be described.

In the transmission system of second transmission unit 7 on rotation shaft 6-*e* at a position more positive along the X axis than partial gear 7-*e*, a link 8-*a* meshing with rotation shaft 6-*e* is provided, that is, link 8-*a* and rotation shaft 6-*e* rotate synchronously about the axis of rotation shaft 6-*e*. On a side of link 8-*a* opposite to rotation shaft 6-*e*, an ascending and descending arm 10 is connected, and link 8-*a* is connected to a generally center portion of ascending and descending arm 10, and ascending and descending arm 10 has a lower end accommodated in an arm accommodation unit (arm accommodator) 11 relatively slidably and has an upper end connected to gripper 4. Arm accommodation unit 11 can rotate about rotation shaft 6-*a* relatively, and a link accommodating groove 10-*a* is formed in ascending and descending arm 10 for regulating a locus of movement of link 8-*a*. Thus, as link 8-*a* rotates, ascending and descending arm 10 swings along the Y axis and therewhile moves relatively with respect to arm accommodation unit 11, and gripper 4 can thus be moved along guide rail 9-*a* of guide unit 9.

Third transmission unit 8 operates in a manner to cause the gripper to operate in the upward and downward direction (i.e., perform a linearly reciprocating operation during a discharging cycle operation done by the gripper), specifically as follows:

As motor M outputs rotation (that is, rotates clockwise in FIG. 7), rotation shaft 6-*a* coupled to the output shaft of motor M starts to rotate, and link 8-*a* is also rotated via pulley 6-*b*, belt 6-*c*, pulley 6-*d* and rotation shaft 6-*e* (clockwise in FIG. 7).

As link 8-*a* rotates, ascending and descending arm 10 accordingly swings along the Y axis and therewhile moves relatively with respect to arm accommodation unit 11. When link 8-*a* rotates clockwise from an outermost position in the negative direction along the Y axis to an outermost position in the positive direction along the Y axis as rotation shaft 6-*e* rotates, gripper 4 moves along guide rail 9-*a* of guide unit 9 to an outermost position in the positive direction along the Y axis. In contrast, when link 8-*a* rotates clockwise from the outermost position in the positive direction along the Y axis to the outermost position in the negative direction along the Y axis as rotation shaft 6-*e* rotates, gripper 4 moves along guide rail 9-*a* of guide unit 9 in a reverse direction to an outermost position in the negative direction along the Y axis. Thus, gripper 4 reciprocates along guide rail 9-*a* of guide unit 9.

FIGS. 9 to 15 are diagrams showing an operation of the sheet transporting mechanism according to one or more embodiments of the present invention. Reference will be made to FIGS. 9 to 15 to describe procedures of operations of first transmission unit 6, second transmission unit 7, and third transmission unit 8, respectively.

Figure 9:
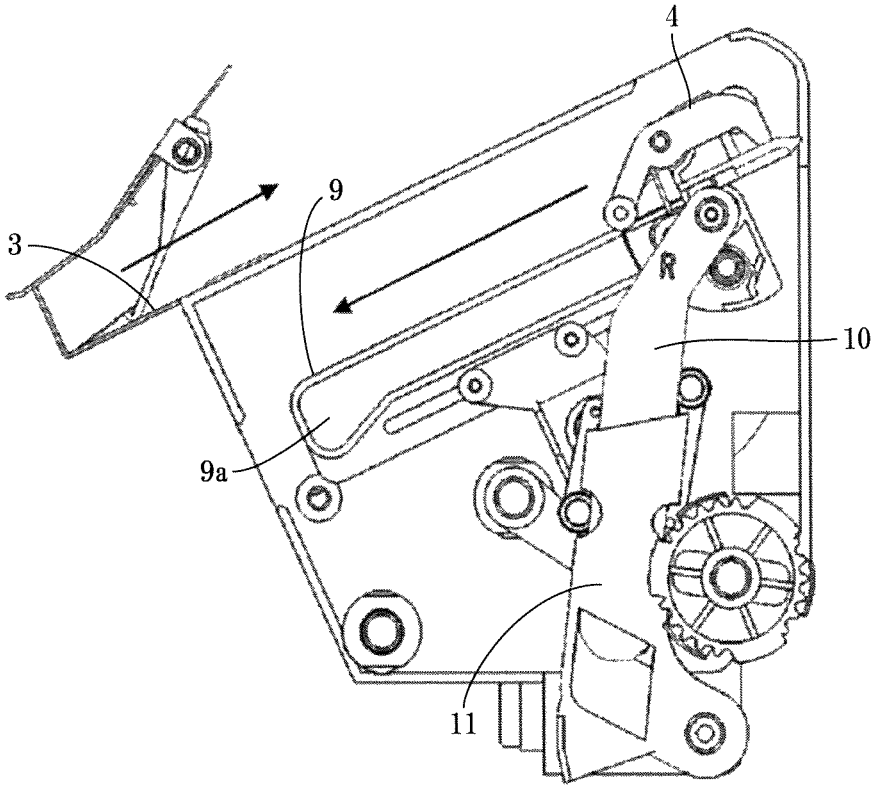
FIGS. 9 to 15 are diagrams showing an operation of the sheet transporting mechanism according to one or more embodiments of the present invention.

Initially, as shown in FIG. 9, thrusting unit 3 starts to move from an upstream end in the sheet discharging direction, or initial position HP, along slide rail 5 toward a downstream side in the sheet discharging direction, and at the same time, gripper 4 is moving from a downstream end in the sheet discharging direction along guide rail 9-*a* toward an upstream side in the sheet discharging direction.

Figure 10:
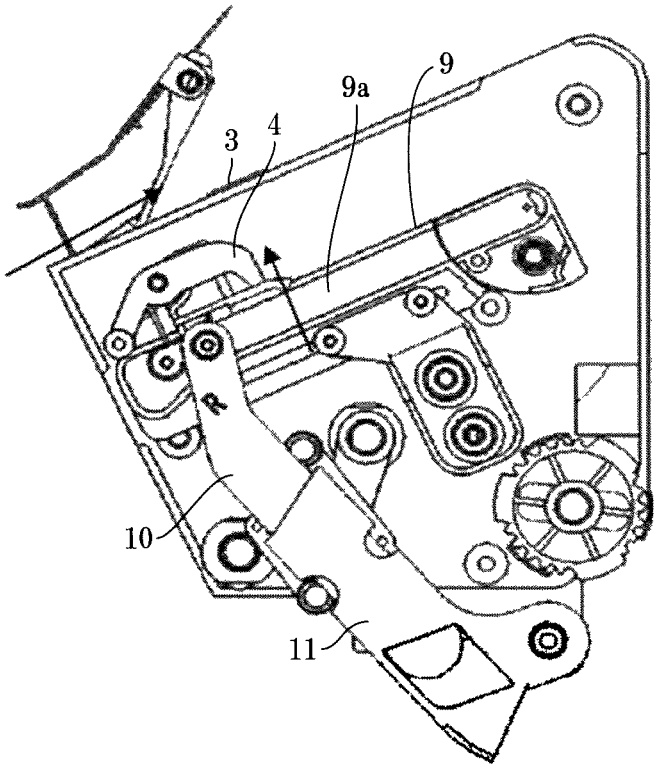

Subsequently, as shown in FIG. 10, as thrusting unit 3 has moved by a distance along slide rail 5 toward the downstream side in the sheet discharging direction, thrusting unit 3 thrusts a sheet by the distance toward the downstream side in the sheet discharging direction, and at the same time, gripper 4 moves along guide rail 9-*a* to an upstream end in the sheet discharging direction.

Figure 11:
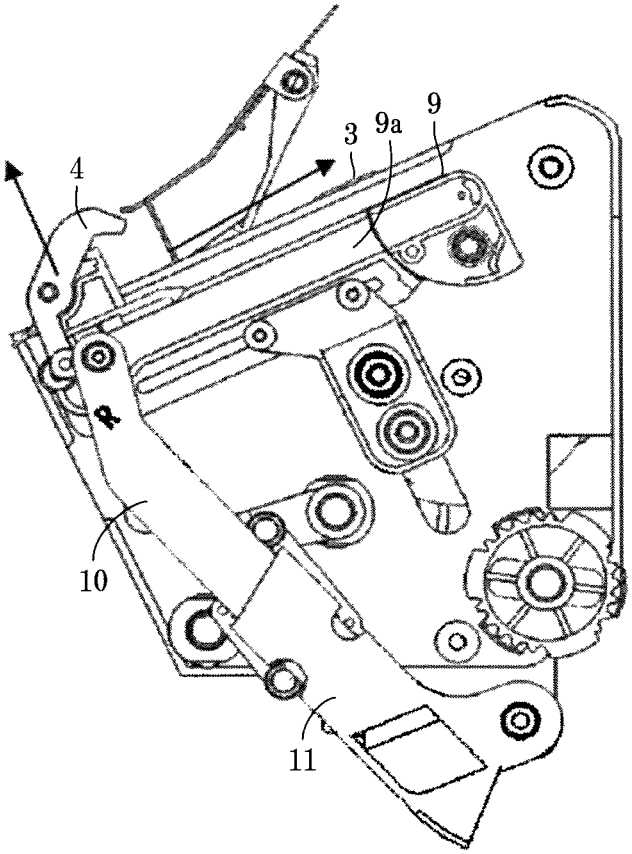

Subsequently, as shown in FIG. 11, as thrusting unit 3 continues to move by a distance along slide rail 5 along the downstream side in the sheet discharging direction, thrusting unit 3 continues to thrust the sheet by the distance toward the downstream side in the sheet discharging direction and at the same time, gripper 4 moves upward along link accommodating groove 10-*a* and lifts up from a surface of storage tray 1 and is thus opened.

Figure 12:
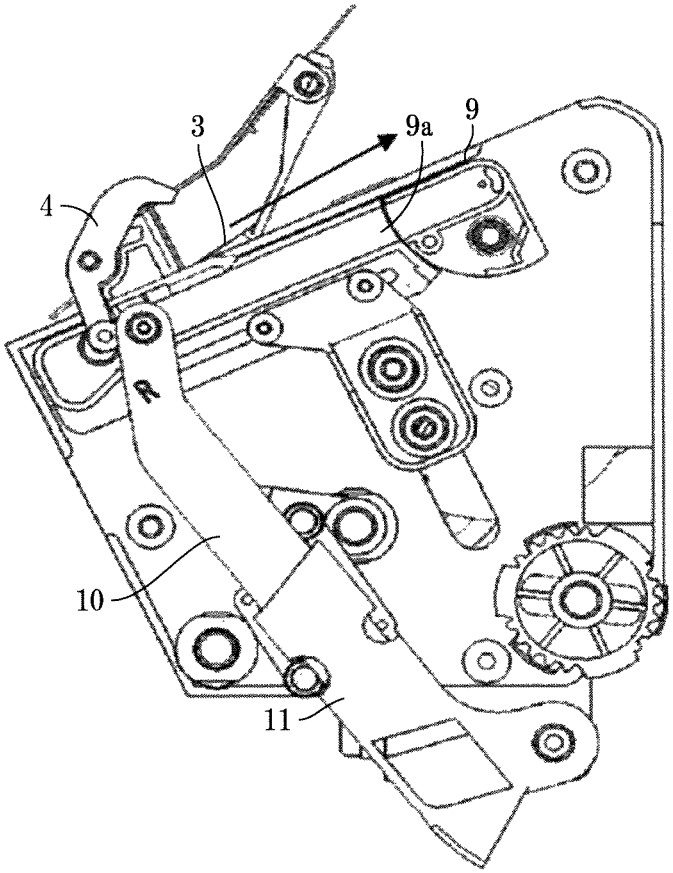

Subsequently, as shown in FIG. 12, as thrusting unit 3 has continued to move by a distance along slide rail 5 along the downstream side in the sheet discharging direction, thrusting unit 3 continues to thrust the sheet by the distance toward the downstream side in the sheet discharging direction, and at the same time, gripper 4 opened while rising from storage tray 1 moves by a distance along guide rail 9-*a* toward the downstream side in the sheet discharging direction.

Figure 13:
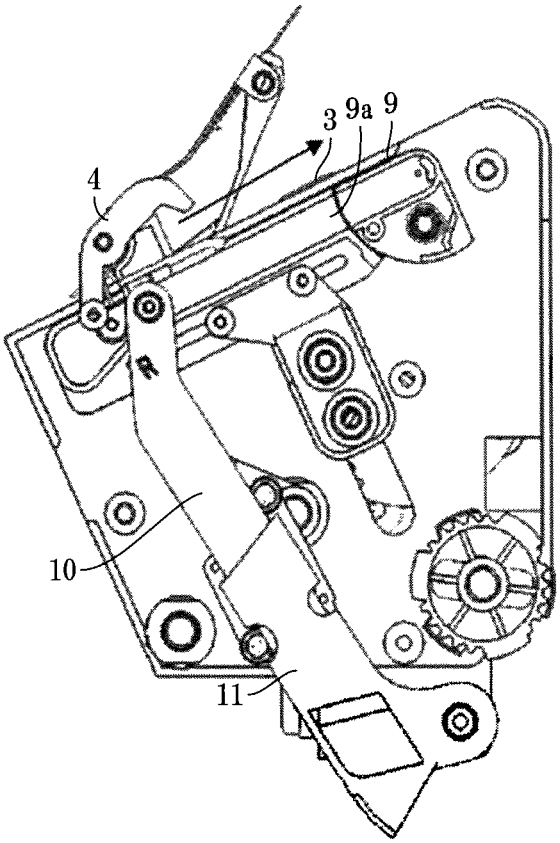

Subsequently, as shown in FIG. 13, before thrusting unit 3 arrives at first position TP, gripper 4 chases and grips the sheet.

Figure 14:
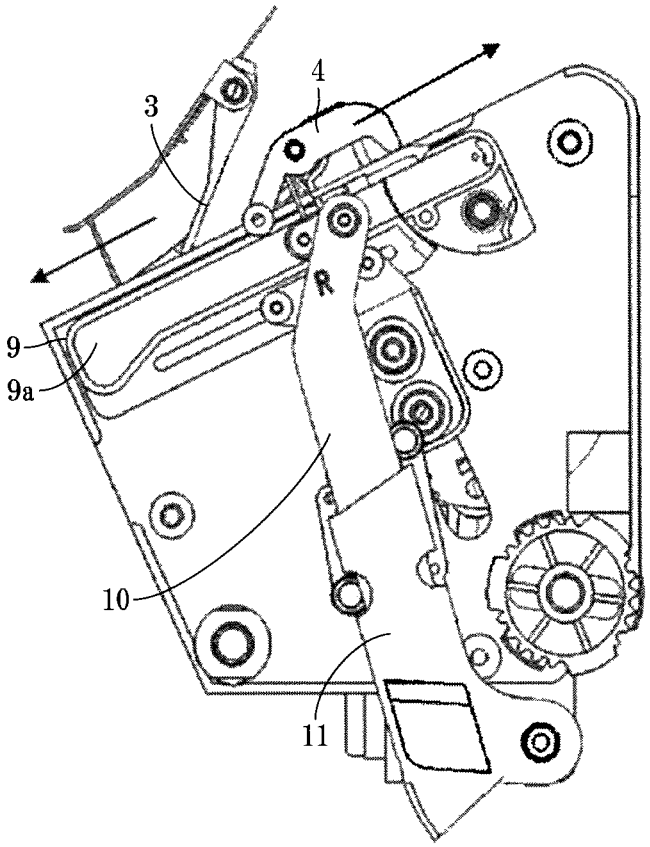

Subsequently, as shown in FIG. 14, after thrusting unit 3 has reached first position TP, it moves along slide rail 5 in the reverse direction toward the upstream side in the sheet discharging direction, and at the same time, gripper 4 having gripped the sheet continues to move along guide rail 9-*a* toward the downstream side in the sheet discharging direction.

Figure 15:
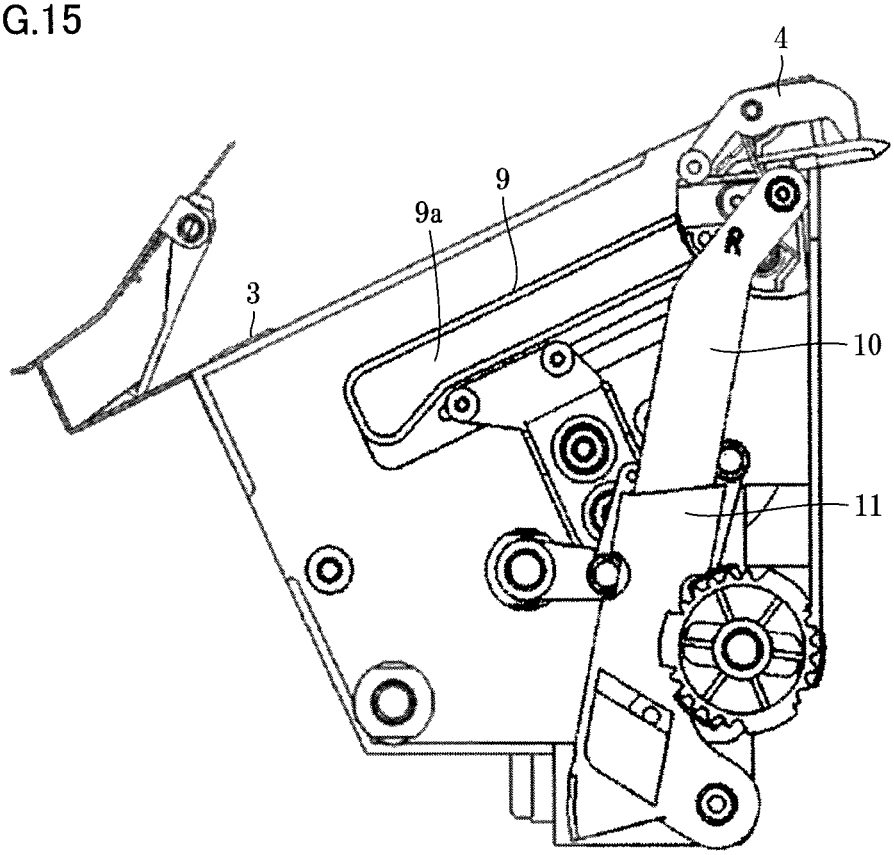

Finally, as shown in FIG. 15, thrusting unit 3 is returned to the upstream end in the sheet discharging direction, or initial position HP, and at the same time, gripper 4 moves along guide rail 9-*a* to the downstream end in the sheet discharging direction and discharges the sheet to stacking tray 2. Thus, one operation cycle is completed. By repeating such a cycle, the sheet transporting mechanism transports a sheet placed on storage tray 1 to stacking tray 2 and discharges the sheet to stacking tray 2.

Figure 16A:
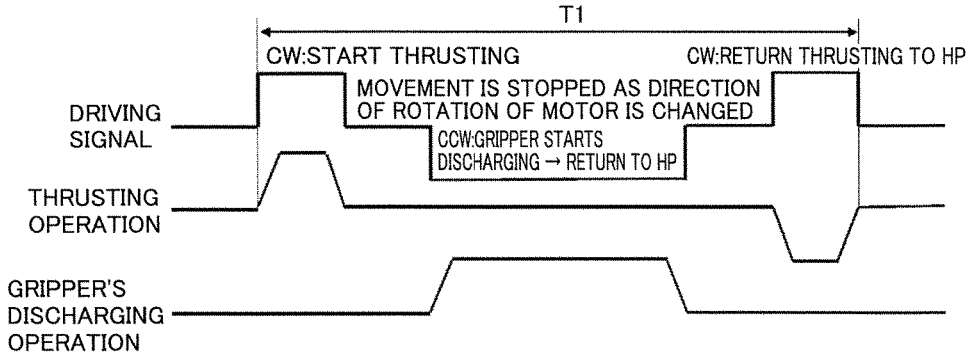
FIG.16A (RELATED ART)
FIG. 16A is a performance chart of a sheet transporting mechanism using two one-way clutches as conventional.
Figure 16B:
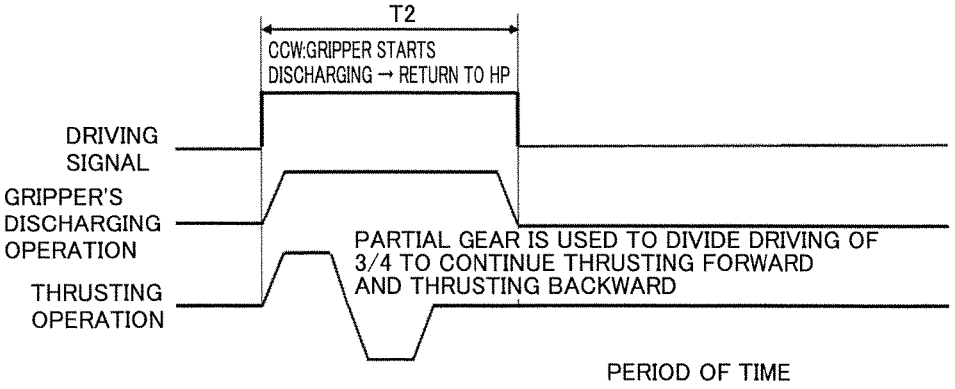
FIG. 16B is a performance chart of the sheet transporting mechanism according to one or more embodiments of the present invention.

FIG. 16A is a performance chart of a sheet transporting mechanism using two one-way clutches as conventional and FIG. 16B is a performance chart of the sheet transporting mechanism according to one or more embodiments of the present invention.

With reference to the performance charts shown in FIGS. 16A and 16B, the sheet transporting mechanism according to one or more embodiments of the present invention is compared with the sheet transporting mechanism using two one-way clutches as conventional. The conventional sheet transporting mechanism necessitates using two one-way clutches, and accordingly, requires changing in an entire period T1 thereof a direction of a driving signal in a double pulse operation method, which includes a CW signal (a forward pulse signal), a stop signal, a CCW signal (a reverse pulse signal), and so on, resulting in poor productivity (that is, simultaneous operation cannot be done and a temporary stop is required), and a characteristic of the one-way clutch results in stopping, and hence poor precision, and separately installing the one-way clutches also invites increased cost. In contrast, the sheet transporting mechanism according to one or more embodiments of the present invention has a motor rotating in one direction, and does not require separately introducing a one-way clutch and can thus achieve a cost reduction.

One or more embodiments of the present invention provide a sheet transporting mechanism in which the second and third transmission units related to the gripper are the same as those in the aforementioned embodiments and the first transmission unit related to the thrusting unit is different from that in the aforementioned embodiments.

Figure 17:
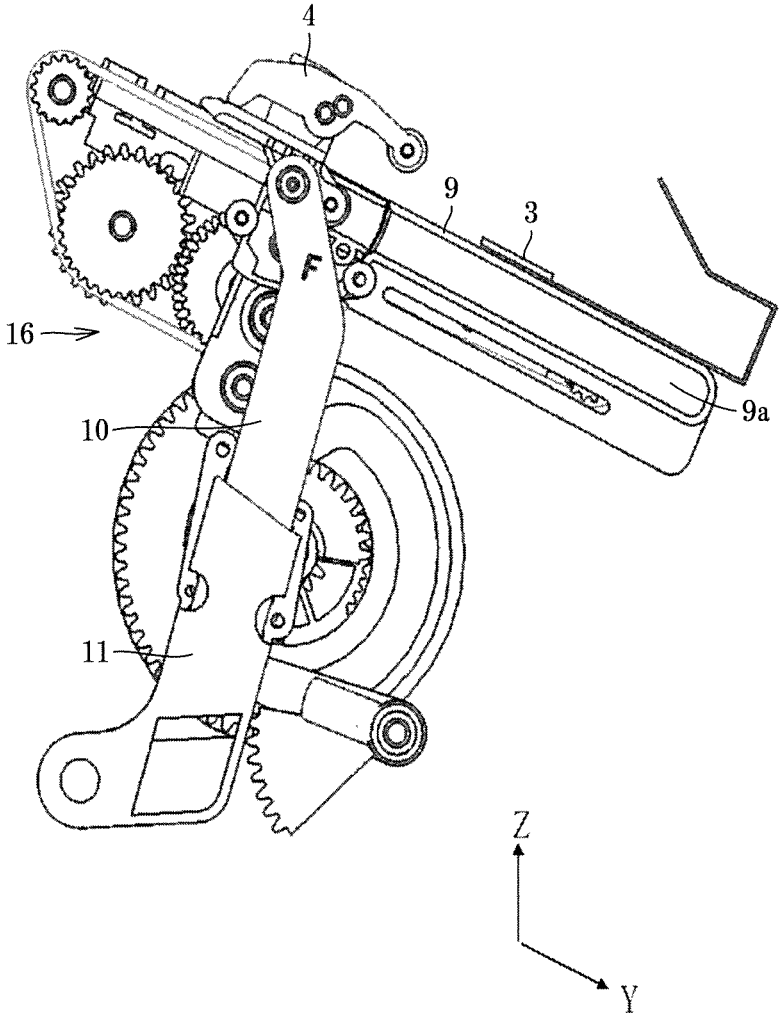
FIG. 17 is a schematic diagram showing a sheet transporting mechanism according to one or more embodiments of the present invention.

A first transmission unit 16 of the sheet transporting mechanism according to one or more embodiments of the present invention is structured specifically as follows:

FIG. 17 is a schematic diagram showing the sheet transporting mechanism according to one or more embodiments of the present invention. FIGS. 18 to 21 are schematic diagrams showing a thrusting operation of the first transmission unit of the sheet transporting mechanism according to one or more embodiments of the present invention.

As shown in FIGS. 17 to 21, first transmission unit 16 includes a partial gear 106 connected to a motor (not shown) and having a first portion 106-*a* and a second portion 106-*c*. First portion 106-*a* and second portion 106-*c* are provided side by side in the gear's axial direction, and first portion 106-*a* has a circumference partially, continuously toothed and partially untoothed. Second portion 106-*c* has a circumference having a continuously toothed portion opposite to the untoothed circumferential portion of first portion 106-*a* in the direction of the axis of rotation, and an untoothed portion. That is, the teeth of second portion 106-*c* and the teeth of first portion 106-*a* are arranged at positions which do not overlap in the axial direction and the teeth of second portion 106-*c* and the teeth of the first portion 106-*a* are not continuous in the circumferential direction.

A gear 106-*b* is meshed with one side of first portion 106-*a* in the negative direction along the Y axis and a gear 106-*d* is meshed with one side of second portion 106-*c* in the negative direction along the Y axis, and gear 106-*b* and gear 106-*d* are coaxially, rotatably disposed. A pulley 106-*f* is provided on a side of gear 106-*b* in the positive direction along the X axis, and pulley 106-*f* is coaxial with gear 106-*b* and can rotate in synchronization with gear 106-*b* coaxially, however, pulley 106-*f* does not rotate in synchronization with gear 106-*d*.

A gear 106-*e* is meshed with a side of gear 106-*d* in the negative direction along the Y axis and a pulley 106-*g* is provided on a side of gear 106-*e* in the positive direction along the X axis, and pulley 106-*g* is coaxial with gear 106-*e* and can rotate in synchronization with gear 106-*e* coaxially.

On opposite sides of slide rail 5, two pulleys 106-*h* and 106-*i* are further disposed together with pulleys 106-*f* and 106-*g*. A belt 106-*j* is wound on pulley 106-*f*, pulley 106-*g*, pulley 106-*h*, and pulley 106-*i* so as to linearly move thrusting unit 3 along slide rail 5.

Figure 18:
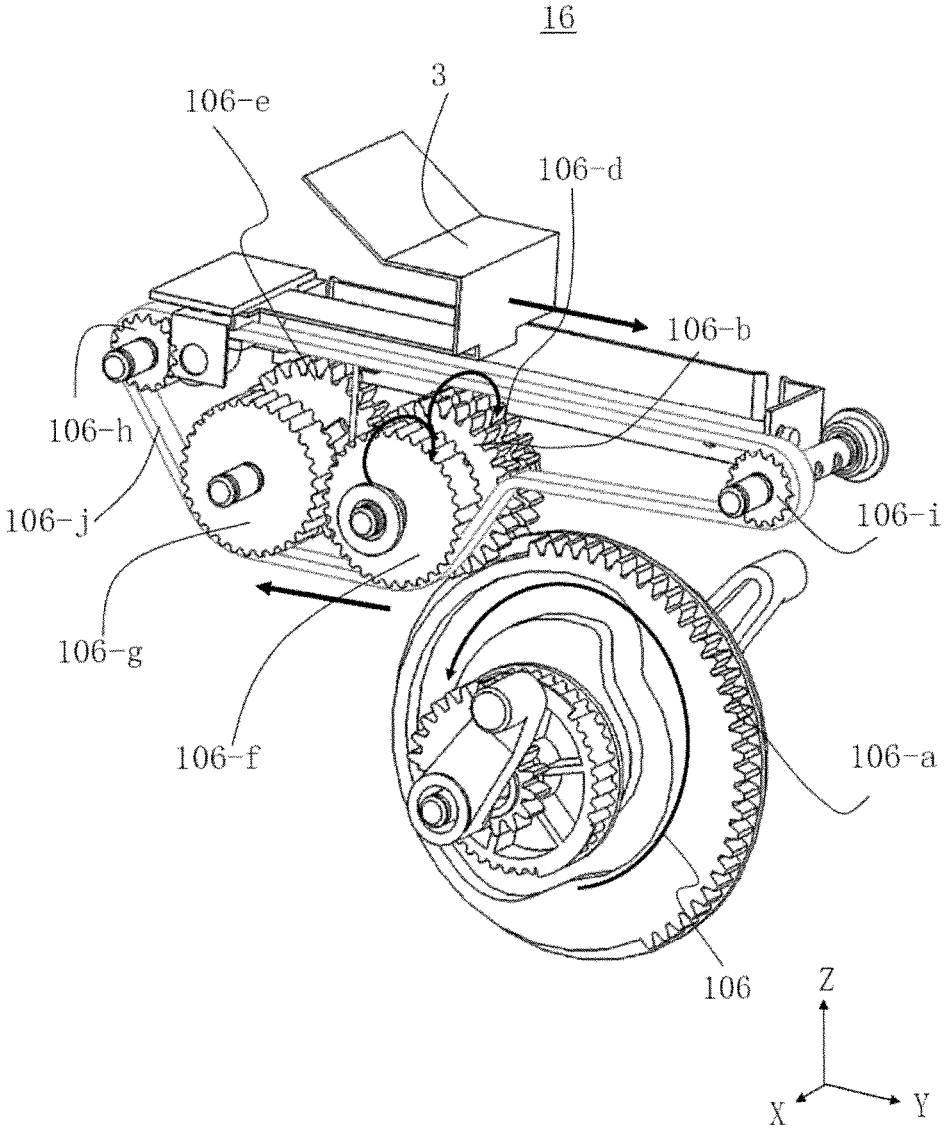
FIG. 18 is a schematic diagram showing a thrusting operation of a first transmission unit of the sheet transporting mechanism according to one or more embodiments of the present invention.

First transmission unit 16 operates in a manner specifically as follows:

As shown in FIG. 18, motor M outputs rotation and drives first transmission unit 6 via a transmission system (not shown) to rotate first transmission unit 6 (counterclockwise in FIG. 18). While first portion 106-*a* has one, toothed side meshed with gear 106-*b*, second portion 106-*c* has one, untoothed side facing gear 106-*d*, and accordingly, first portion 106-*a* drives gear 106-*b* to rotate it clockwise, and simultaneously, gear 106-*d* does not mesh with second portion 106-*c* and thus does not rotate, and at that time, gear 106-*b* drives pulley 106-*f* to rotate it clockwise, and accordingly, belt 106-*j* is also rotated clockwise, whereby thrusting unit 3 can be driven to linearly move in the positive direction along the Y axis toward initial position HP.

Figure 19:
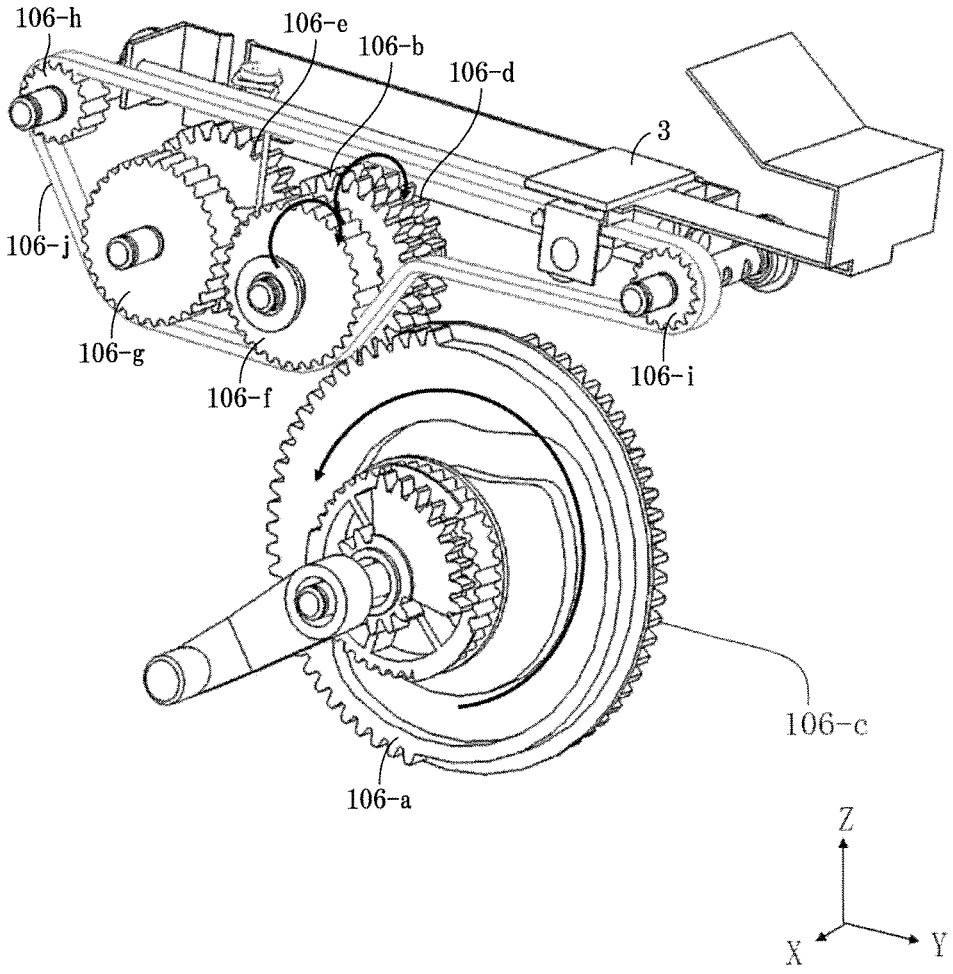
FIG. 19 is a schematic diagram showing a thrusting operation of the first transmission unit of the sheet transporting mechanism according to one or more embodiments of the present invention.

As shown in FIG. 19, when first portion 106-*a* has one, untoothed side facing gear 106-*b* and, at the same time, second portion 106-*c* has one, untoothed side facing gear 106-*d*, gear 106-*b* and gear 106-*d* both do not transmit power, and thrusting unit 3 is stopped from moving.

Figure 20:
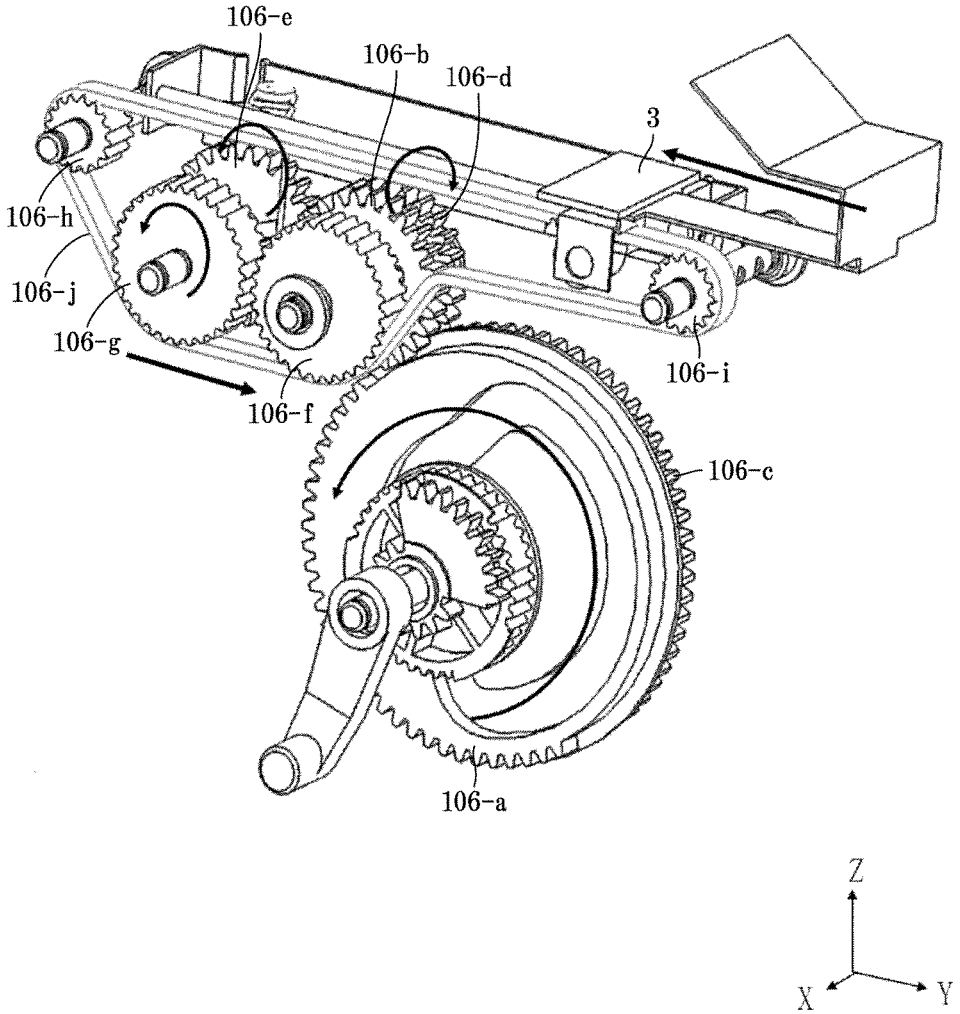
FIG. 20 is a schematic diagram showing a thrusting operation of the first transmission unit of the sheet transporting mechanism according to one or more embodiments of the present invention.
Figure 21:
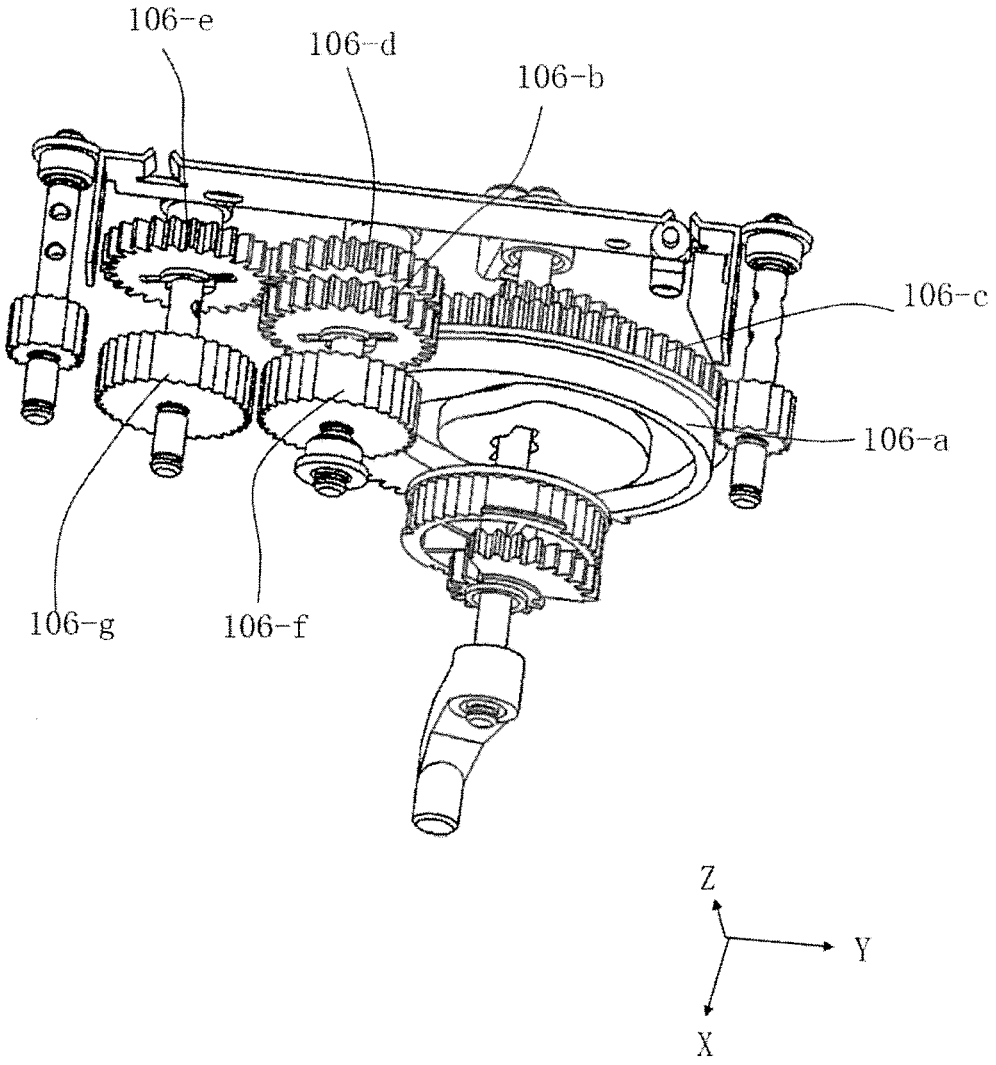
FIG. 21 is a schematic diagram showing a thrusting operation of the first transmission unit of the sheet transporting mechanism according to one or more embodiments of the present invention.

As shown in FIG. 20, while first portion 106-*a* has one, untoothed side facing gear 106-*b*, second portion 106-*c* has one, toothed side meshed with gear 106-*d*, and accordingly, second portion 106-*c* drives gear 106-*d* to rotate it clockwise, and simultaneously, gear 106-*b* does not mesh with first portion 106-*a* and thus does not rotate, and at that time, gear 106-*e* meshing with gear 106-*d* starts to rotate counterclockwise and gear 106-*e* drives pulley 106-*g* to rotate it counterclockwise, and accordingly, belt 106-*j* is also rotated counterclockwise, whereby thrusting unit 3 can be driven to linearly move in the negative direction along the Y axis toward first position TP.

As has been set forth above, causing thrusting unit 3 to reciprocate along slide rail 5 within a predetermined range, that is, between initial position HP and first position TP, transports a sheet from initial position HP toward the stacking tray.

The sheet transporting mechanism thus described above is a sheet transporting mechanism that transports a sheet from a storage tray 1 to a stacking tray 2, comprising: a first transporting member 3 configured to move between an initial position HP and a first position TP to transport the sheet from initial position HP toward stacking tray 2; a second transporting member 4 configured to take over transporting to stacking tray 2 the sheet transported by first transporting member 3; a single motor M solely provided in the sheet transporting mechanism and configured to drive first transporting member 3 and second transporting member 4; a guide unit 9 configured to guide movement of second transporting member 4; a first transmission unit 6 configured to transmit a driving force of motor M to first transporting member 3 to move first transporting member 3 between initial position HP and first position TP; a second transmission unit 7 configured to transmit the driving force of motor M to guide unit 9 to move guide unit 9 in an upward and downward direction; and a third transmission unit 8 configured to transmit the driving force of motor M to second transporting member 4 to allow second transporting member 4 to be guided by guide unit 9 and thus moved, first transmission unit 6 having a driving force interruption unit configured to temporarily interrupt the driving force to be transmitted to first transporting member 3.

With this configuration, the mechanism is driven by a single motor, and can thus be less costly than when two motors are used. Moreover, the single motor may be an ordinary motor and there is no need to adopt an expensive stepping motor, which can contribute to a further cost reduction. Furthermore, the second transporting member, or a gripper, that ascends and descends up and down can reciprocate within a range below a sheet passage plane, and productivity can be increased. When compared with a case using two one-way clutches, the one-way clutches can be dispensed with, and cost reduction can be achieved.

The sheet transporting mechanism has a rotation shaft 6-*e* transmitting the rotation of motor M, and first transmission unit 6, second transmission unit 7, and third transmission unit 8 are each operated via the rotation shaft as motor M operates.

With the above configuration, a single motor can be used to drive first transmission unit 6, second transmission unit 7, and third transmission unit 8 simultaneously, and reduced cost and increased productivity can be coestablished.

In the sheet transporting mechanism, the driving force interruption unit may be a partial gear 106 having a circumference partially, continuously toothed and partially untoothed.

With this configuration, the function of first transmission unit 6 can be implemented by a simple member that is partial gear 106 alone, and it is unnecessary to use two motors or two one-way clutches, and improvement in productivity can be achieved while reduction in cost can be achieved.

In the sheet transporting mechanism, first transmission unit 16 further includes a first gear group (106-*b*, 106-*d*, 106-*e*, 106-*f*, 106-*g*) ganged or interlocked with partial gear 106, and a conversion member (convertor) 106-*j* ganged or interlocked with the first gear group (106-*b*, 106-*d*, 106-*e*, 106-*f*, 106-*g*) and first transporting member 3, and configured to convert rotational movement of the first gear group (106-*b*, 106-*d*, 106-*e*, 106-*f*, 106-*g*) to linearly (or laterally) move first transporting member 3.

With this configuration, the first transmission unit is composed of a gear group and a conversion member, e.g., a belt or a similar simple member, and as a result, the first transporting member can be linearly moved by a simple structure.

In the sheet transporting mechanism, conversion member 106-*j* includes a plurality of pulleys 106-*h* and 106-*i* and a belt 106-*j*.

With this configuration, the first transmission unit is composed of a gear group and a conversion member, e.g., a belt or a similar simple member, and as a result, the first transporting member can be linearly moved by a simple structure.

In the sheet transporting mechanism, partial gear 106 that first transmission unit 16 has includes a first portion 106-*a* and a second portion 106-*c*. First portion 106-*a* and second portion 106-*c* are provided side by side in the gear's axial direction. First portion 106-*a* has a circumference partially, continuously toothed, and second portion 106-*c* has a circumference having a continuously toothed portion opposite to an untoothed circumferential portion of first portion 106-*a* in the direction of the axis of rotation. The teeth of second portion 106-*c* and the teeth of the first portion 106-*a* are not continuous in the circumferential direction. The first gear group (106-*b*, 106-*d*, 106-*e*, 106-*f*, 106-*g*) includes a first gear 106-*b* intermittently meshing with first portion 106-*a*, a second gear 106-*d* intermittently meshing with second portion 106-*c*, a third gear 106-*e* meshing with second gear 106-*d*, a first pulley 106-*f* that rotates in synchronization with first gear 106-*b*, and a second pulley 106-*g* that rotates in synchronization with third gear 106-*e*. The conversion member includes a belt wound on the first pulley and the second pulley. First portion 106-*a* is ganged or interlocked with first transporting member 3 via first gear 106-*b*, first pulley 106-*f* and belt 106-*j*, and second portion 106-*c* is ganged or interlocked with first transporting member 3 via second gear 106-*d*, third gear 106-*e*, second pulley 106-*g*, and belt 106-*j*. When partial gear 106 rotates, while first portion 106-*a* has its toothed circumferential portion meshed with first gear 106-*b*, first transporting member 3 is ganged or interlocked to move in a first direction, whereas while second portion 106-*c* has its toothed circumferential portion meshed with second gear 106-*d*, first transporting member 3 is ganged or interlocked to move in a second direction opposite to the first direction.

With this configuration, the first transmission unit is composed of a gear group and a conversion member, e.g., a belt or a similar simple member, and as a result, the first transporting member can be linearly moved by a simple structure.

In the sheet transporting mechanism, second transmission unit 7 includes a cam 7-*a* coupled to rotation shaft 6-*e*, and a second gear group ganged or interlocked with cam 7-*a* and guide unit 9 and converting rotational movement of cam 7-*a* to cause guide unit 9 to make a linear (or upward/downward) movement in an upward and downward direction.

With this configuration, the second transmission unit is composed of a gear group and a cam or a similar simple member, and as a result, a simple structure can be used to cause guide unit 9 to make a linear movement in an upward and downward direction and furthermore, to cause the second transporting member, or a gripper, to make a reciprocating movement in an upward and downward direction.

In the sheet transporting mechanism, third transmission unit 8 includes an ascending and descending arm 10 and an arm accommodation unit 11, and transmits the driving force of motor M to second transporting member 4 through a movement of ascending and descending arm 10 to allow second transporting member 4 to be guided by guide unit 9 and thus moved.

With this configuration, the third transmission unit is composed of simple members such as a link, an ascending and descending arm and an arm accommodation unit, and as a result, the second transporting member, that is, the gripper, can be caused to reciprocate along the guide unit.

In the sheet transporting mechanism, second transporting member 4 may further be a gripper to pinch a sheet while transporting the sheet.

The image formation apparatus described above includes the sheet transporting mechanism described above.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. A sheet transporting mechanism that transports a sheet from a storage tray to a stacking tray, comprising:

a first transporter that moves between an initial position and a first position to transport the sheet from the initial position toward the stacking tray;

a second transporter that transports the sheet transported by the first transporter to the stacking tray;

a single motor that drives the first transporter and the second transporter;

a guide rail that guides movement of the second transporter;

a first transmission gear that transmits a driving force of the single motor to the first transporter to move the first transporter between the initial position and the first position;

a second transmission gear that transmits the driving force of the single motor to the guide rail to move the guide rail in an upward and downward direction; and a third transmission gear that transmits the driving force of the single motor to the second transporter to allow the second transporter to be guided by the guide rail, wherein the first transmission gear has a driving force interruption mechanism that temporarily interrupts the driving force to be transmitted to the first transporter, and no other motor besides the single motor drives the first transporter and the second transporter.

2. The sheet transporting mechanism according to claim 1, further comprising:

a rotation shaft that transmits rotation of the single motor, wherein the first transmission gear, the second transmission gear, and the third transmission gear are each operated via the rotation shaft as the single motor operates.

3. The sheet transporting mechanism according to claim 1, wherein the driving force interruption mechanism is a partial gear that has a circumference partially and continuously toothed, and partially untoothed.

4. The sheet transporting mechanism according to claim 3, wherein the first transmission gear comprises:

a first gear group that is interlocked with the partial gear; and a convertor that is interlocked with the first gear group and the first transporter and converts rotational movement of the first gear group to linearly move the first transporter.

5. The sheet transporting mechanism according to claim 4, wherein the convertor comprises a plurality of rollers and a belt.

6. The sheet transporting mechanism according to claim 4, wherein the partial gear of the first transmission gear comprises a first portion and a second portion, the first portion and the second portion are disposed side by side in the axial direction of the partial gear, the first portion has a circumference partially and continuously toothed, the second portion has a circumference having a continuously toothed portion opposite an untoothed circumferential portion of the first portion in a direction of a rotation axis, teeth of the second portion and teeth of the first portion are not continuous in a circumferential direction, the first gear group comprises:

a first gear intermittently meshing with the first portion, a second gear intermittently meshing with the second portion, a third gear meshing with the second gear, a first pulley that rotates in synchronization with the first gear, and a second pulley that rotates in synchronization with the third gear, the convertor comprises a belt wound on the first pulley and the second pulley, the first portion is interlocked with the first transporter via the first gear, the first pulley, and the belt, the second portion is interlocked with the first transporter via the second gear, the third gear, the second pulley, and the belt, when the partial gear rotates, while the toothed portion of the circumference of the first portion meshed with the first gear, the first transporter is interlocked to move in a first direction, whereas while the toothed portion of the circumference of the second portion meshed with the second gear, the first transporter is interlocked to move in a second direction opposite to the first direction.

7. The sheet transporting mechanism according to claim 1, wherein the second transmission gear comprises:

a cam coupled to a rotation shaft transmitting rotation of the single motor; and a second gear group interlocked with the cam and the guide rail and converting rotational movement of the cam to linearly move the guide rail in an upward and downward direction.

8. The sheet transporting mechanism according to claim 1, wherein the third transmission gear comprises:

an ascending and descending arm; and an arm accommodator accommodating the ascending and descending arm extendably and retractably, wherein the third transmission gear transmits a driving force of the single motor to the second transporter through a movement of the ascending and descending arm to allow the second transporter to be guided by the guide rail and thus moved.

9. The sheet transporting mechanism according to claim 1, wherein the second transporter comprises a gripper to pinch a sheet while transporting the sheet.

10. An image formation apparatus comprising the sheet transporting mechanism according to claim 1.

* * * * *